US006315118B1

(12) United States Patent
Sauce

(10) Patent No.: US 6,315,118 B1
(45) Date of Patent: Nov. 13, 2001

(54) DISPENSER BOX FOR CABLING ACCESSORIES, AND CORRESPONDING LOADER

(75) Inventor: Yves Sauce, Eslettes (FR)

(73) Assignees: Legrand; Legrand SNC, both of Limoges (FR)

( * ) Notice: Subject to any disclaimer, the term of this patent is extended or adjusted under 35 U.S.C. 154(b) by 0 days.

(21) Appl. No.: 09/535,736

(22) Filed: Mar. 27, 2000

(30) Foreign Application Priority Data

Mar. 31, 1999 (FR) ..... 99 04010

(51) Int. Cl.[7] ..... B65D 85/24
(52) U.S. Cl. ..... 206/338; 206/345; 221/70
(58) Field of Search ..... 206/223, 338, 206/340, 341, 343–346, 470, 464, 465, 408, 411, 413, 701, 716, 723, 725, 231; 29/747, 748, 729, 745, 809; 414/288, 287; 221/25, 70–73

(56) References Cited

U.S. PATENT DOCUMENTS 3,776,375 * 12/1973 Rohdin ..... 206/470
4,723,723 * 2/1988 Asahi et al. ..... 206/338
4,784,262 11/1988 Duddy et al. .
5,205,407 * 4/1993 Tu ..... 206/338
5,299,686 * 4/1994 Bromley et al. ..... 206/338
5,316,139 * 5/1994 Judd et al. ..... 206/470
5,735,408 * 4/1998 Fukuda et al. ..... 206/723

FOREIGN PATENT DOCUMENTS 0 202 103 11/1986 (EP) .
0 380 388 8/1990 (EP) .

* cited by examiner

*Primary Examiner*—Luan K. Bui
(74) *Attorney, Agent, or Firm*—Young & Thompson

(57) ABSTRACT

The dispenser box according to the invention is characterized in that it is formed by two shells (14A, 14B), which are brought face-to-face along a joint surface (S), being duly fastened to one another, and jointly delimiting with one another an accommodation volume (V) suitable for housing the cabling accessories (10) to be dispensed in a roll, and in that it includes, externally, a docking element (16), such as a projecting rib or recessed groove, suitable for allowing it to be affixed to any other piece of equipment, for example onto a straight-line loader, that is to say a loader which is normally suitable only for receiving a linear arrangement of cabling accessories (10), with, at a distance from this docking element (16), an aperture (17) suitable for the cabling accessories (10) to pass.

26 Claims, 3 Drawing Sheets

DISPENSER BOX FOR CABLING ACCESSORIES, AND CORRESPONDING LOADER

BACKGROUND OF THE INVENTION

1. Field of the Invention

The present invention relates in general to the dispensing of cabling accessories to a tool suitable for putting them into use.

It relates more particularly to the dispensing of the type of cabling accessories which, like those commonly called terminations, are to be crimped onto the previously bared end of the conducting core of electrical conductors with a view to allowing them to be connected, in a simpler and more reliable way, to any connection terminal.

2. Description of the Related Art

More particularly still, the present invention relates to the dispensing of such cabling accessories to a crimping tool, or, put another way, to the supplying of the tool with such cabling accessories.

This crimping tool may, for example, be of the type described in the French patent which, filed on Feb. 5, 1988, under No. 88 01355, was published under No 2 626 803.

It takes the form, in practice, of pliers which are supplied with cabling accessories with the aid of a straight-line loader, that is to say with the aid of a loader suitable for receiving a straight-line arrangement of these cabling accessories, whether they are put in place in the form of a strip within which they are successively linked to one another, of whether they are put in place individually one after the other.

This arrangement has given satisfaction, and may continue to do so.

However, taking the form, in practice, of an overall rectangular plate, a straight-line loader inevitably has a relatively restricted capacity in terms of cabling accessories.

BRIEF SUMMARY OF THE INVENTION

The subject of the present invention, in a general way, is an arrangement making it possible markedly to increase this capacity, if desired.

It is based on the fact, known in itself, that, when they are linked in a strip, the cabling accessories of the type in question can be arranged into a roll instead of being simply lined up, the strip which they form itself exhibiting sufficient flexibility to be able to be wound up into a spiral.

More precisely, the subject of the present invention is, first of all, a dispenser box for cabling accessories, particularly for cable terminations, characterised in that it is formed by two shells, which are brought face-to-face along a common joint surface, being duly fastened to one another, and jointly delimiting with one another an accommodation volume suitable for housing the cabling accessories to be dispensed, and in that it includes, externally, a docking element, such as a projecting rib or recessed groove, suitable for allowing it to be affixed to any other piece of equipment, with, at a distance from this docking element, an aperture suitable for the cabling accessories to pass.

Via its docking element, the dispenser box according to the invention may, for example, be affixed to a straight-line loader, thus advantageously increasing the capacity thereof.

It is sufficient, to do this, for this loader to be equipped with a docking element complementary to its own docking element.

Hence, from this point of view, a further subject of the invention is any loader which, normally able to accommodate a simple straight-line arrangement of wiring accessories, includes, externally, such a complementary docking element.

When, by way of the docking elements thus provided for this purpose, a dispenser box is affixed to such a straight-line loader, it is sufficient to introduce, into the latter, the strip of wiring accessories which it contains, transfer taking place in practice thanks to its aperture and to that of the extremities, previously cleared, of the loader which is opposite that at which the crimping occurs.

Preferably, according to one embodiment which is particularly simple and inexpensive to produce, the two shells of the dispenser box according to the invention are of a single piece with one another, being articulated to one another by a hinge area.

For example, the assembly is produced by thermoforming.

Preferably, also, advantage is then taken of the hinge area thus present between these two shells in order to form the docking element making it possible to affix the assembly to another piece of equipment.

Thus, the construction of this docking element advantageously does not, by itself, require any other particular provision.

The characteristics and advantages of the invention will emerge further from the description which will follow, by way of example, by reference to the atached diagrammatic drawings.

DETAILED DESCRIPTION OF THE INVENTION

Figure 1:
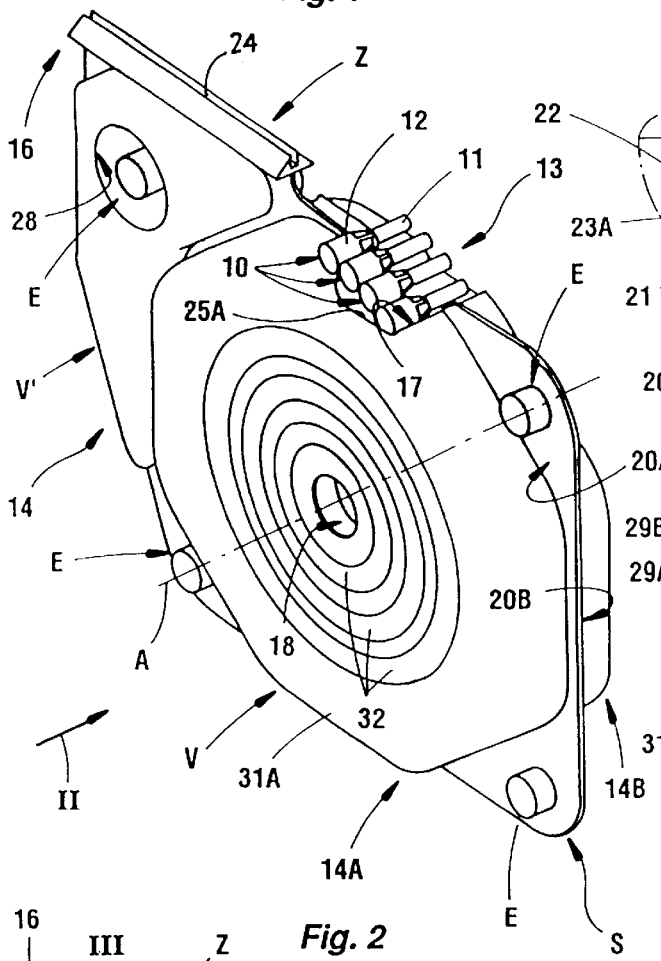
FIG. 1 is a view in perspective of a dispenser box according to the invention, and of the outer part, all that is visible, of the roll of cabling accessories which it contains.
Figure 3:
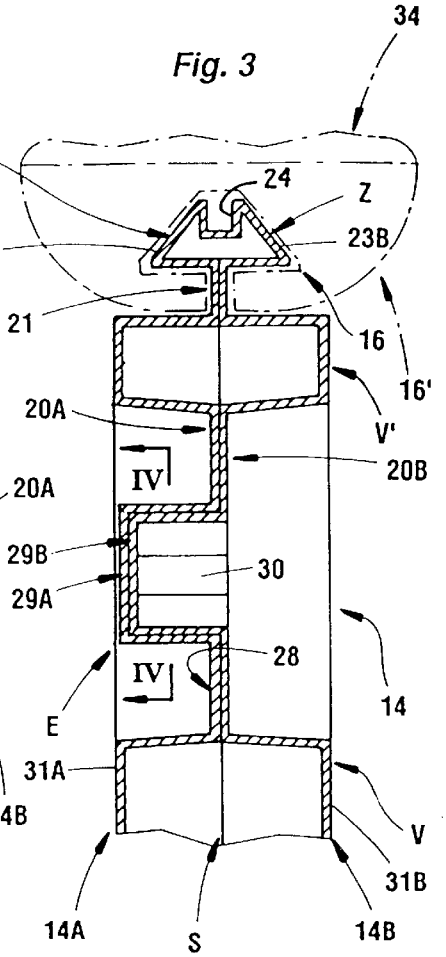
FIG. 3 is a partial view of it in cross-section, on a larger scale, along the line III—III of FIG. 2.

These figures illustrate, by way of example, the application of the invention to the case in which the cabling accessories 10 to be dispensed are cable terminations including, on the one hand, a metal barrel 11, intended to be engaged, and crimped, onto the previously bared end of the conducting core of any electrical conductor, not represented, and, on the other hand, a collar of insulating material 12, itself intended to be engaged on the sheath of this electrical conductor.

Such a cabling accessory being well known in itself, and not, in itself, coming under the present invention, it will not be described in further detail here.

It will be sufficient to indicate that, in the embodiment represented, the cabling accessories 10 to be dispensed form a continuous strip 13, within which they are successively articulated to one another in a detachable way, and which, in itself, is sufficiently flexible to be able to be wound up into a spiral, in the manner of a roll.

According to the invention, a dispenser box 14 is employed for accommodating and taking out cabling accessories 10 thus forming a roll.

According to the invention, also, this dispenser box 14 is formed overall from two shells 14A, 14B, which are brought face-to-face with one another along a joint surface S common to both of them, being duly fastened to one another according to arrangements described in further detail later, and jointly delimiting with one another an accommodation volume V suitable for housing cabling accessories 10 to be dispensed, and, according to arrangements also described in further detail later, it includes, externally, a docking element 16, such as a projecting rib or recessed groove, suitable for allowing it to be affixed onto any other piece of equipment, with, at a distance from this docking element 16, an aperture 17 suitable for the cabling accessories 10 to pass.

Preferably, and this is the case in the embodiment represented, the two shells 14A, 14B are articulated to one another by a hinge area Z, and the latter by itself forms the docking element 16.

The accommodation volume V formed by the two shells 14A, 14B is cylindrical overall.

Figure 2:
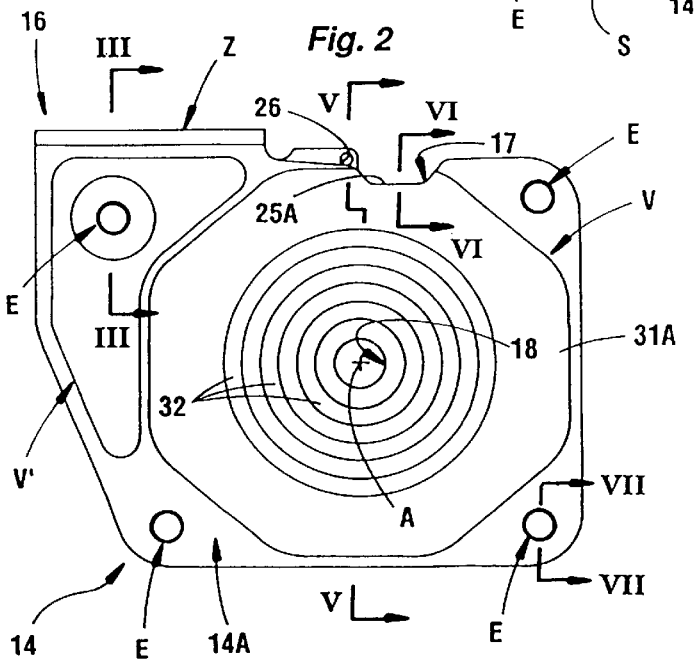
FIG. 2 is a view of this dispenser box in elevation, represented empty, on a smaller scale and along the arrow II of FIG. 1.
Figure 4:
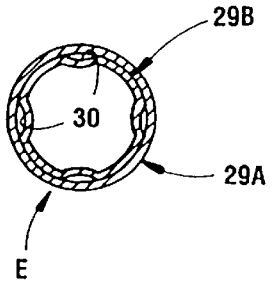
FIG. 4 is a partial view of it, in longitudinal section, to the same scale as FIG. 3, along the line IV—IV of FIG. 3.
Figure 5:
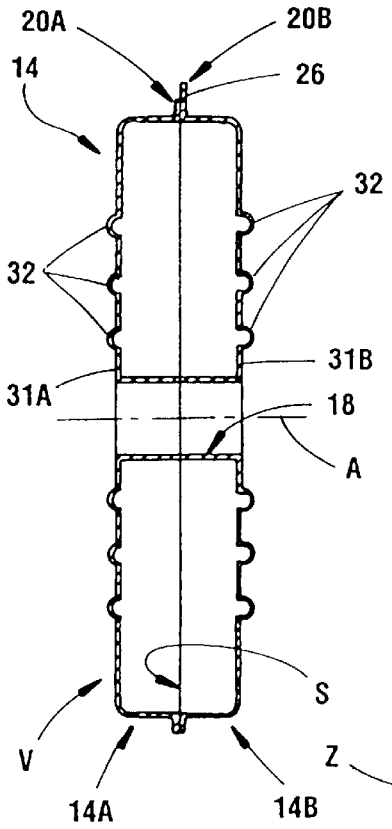
FIG. 5 is a view of it in cross-section, on a smaller scale, along the broken line V—V of FIG. 2.
Figure 6:
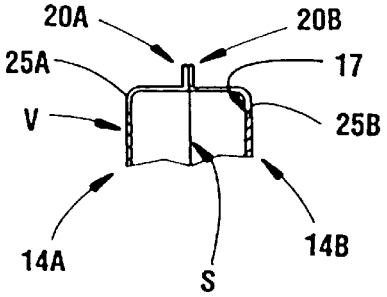
FIGS. 6 and 7 are partial views of it in cross-section, each along, respectively, the lines VI—VI and VII—VII of FIG. 2.
Figure 7:
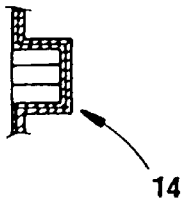

Let A be its axis, as shown diagrammatically in dashed line in FIGS. 1 and 5, and as identified by its mark in FIG. 2.

In the embodiment represented, this accommodation volume V extends in annular fashion around a central hole 18 suitable for allowing a spindle to pass while it is being filled with cabling accessories 10.

For example, and as represented, the outer periphery of this accommodation volume V has an overall octagonal contour, and its inner periphery has an overall circular contour.

In the embodiment represented, the central hole 18 is lined in halves by each of the shells 14A, 14B.

However, in a variant, it could equally well be lined by only one of these shells 14A, 14B, or be bare.

In the embodiment represented, the two shells 14A, 14B, each respectively form, around the accommodation volume V, over at least a part of the periphery thereof, two flanges 20A, 20B which extend substantially perpendicularly to the axis A of this accommodation volume V, and which, contiguous with one another, define the joint surface S of these two shells 14A, 14B, such that this joint surface S is flat.

The docking element 16 extends longitudinally along one of the edges of the flanges 20A, 20B of the two shells 14A, 14B, going away from the accommodation volume V, and substantially orthogonally with respect to the axis A thereof.

In practice, this docking element 16 extends on either side of the joint surface S of the two shells 14A, 14B, being distributed in halves on each of them.

In the embodiment represented, the docking element 16 forms a projecting rib, and, exhibiting a shank 21 and a head 22, it has, transversely, an overall T-shaped profile.

In practice, the shank 21 of this docking element 16 is no more than a portion of the flanges 20A, 20B of the two shells 14A, 14B.

Preferably, and this is the case in the embodiment represented, the longitudinal flanks 23A, 23B of the head 22 of the docking element 16 are oblique with respect to one another, approaching one another in proportion to their distance from the shank 21 of this docking element 16.

More precisely, in the embodiment represented, the head 22 of the docking element 16 has, transversely, an overall trapezoidal profile.

Moreover, in this embodiment, it exhibits a groove 24, longitudinally along the small base of its profile.

In the embodiment represented, the aperture 17 of the dispenser box 14 occurs in the side face of the accommodation volume V, at the outer periphery thereof.

In practice, this aperture 17 extends in the immediate vicinity of the docking element 16, and, like it, it is distributed in halves over each of the two shells 14A, 14B.

In practice, this aperture 17 results from notches 25A, 25B each respectively locally affecting the shells 14A, 14B, extending symmetrically over both of them.

Preferably, and this is the case in the embodiment represented, the flange 20A, 20B of at least one of the two shells 14A, 14B exhibits, at the edge of the aperture 17, a piercing 26 suitable for engaging a cabling accessory 10 by its metal barrel 11.

For example, and as represented, this is the case only for the flange 20B of shell 14B alone, the flange 20A of the shell 14A being correspondingly truncated in line with this piercing 26 in order to leave free access thereto.

In practice, the piercing 26 extends at an intermediate level between that of the docking element 16 and that of the aperture 17.

In the embodiment represented, the two shells 14A, 14B are fastened to one another by interlocking areas E which occur from place to place around the accommodation volume V.

For example, and as represented, four interlocking areas E are thus provided, in a rectangle, around the reception volume V.

One of them extends vertically below the docking element 16.

It occurs, in practice, within a well 28 delimited by a stiffening volume V', which, formed at this spot by the two shells 14A, 14B, for local stiffening of the assembly, locally runs along the reception volume V.

The other interlocking areas E themselves occur, in isolation, on the free surfaces of the flanges 20A, 20B.

In the embodiment represented, each of the interlocking areas E is formed by two bosses 29A, 29B which each respectively belong to the flanges 20A, 20B of the two shells 14A, 14B, projecting in the same direction on these flanges 20A, 20B, and which, complementary to one another, are interlocked into one another.

In practice, the innermost boss 29A, 29B, in this instance the boss 29B belonging to the shell 14B, includes, peripherally, from place to place, recessed over its outer surface, along its generatrices, grooves 30 in order to facilitate its interlocking into the outermost boss 29A, 29B, in this instance the boss 29A belonging to the shell 14A.

For example, and as represented, four grooves 30 are thus provided in recess on the innermost boss 29B.

Preferably, in order to guarantee the integrity of the dispenser box 14 according to the invention, the two shells 14A, 14B are secured to one another in line with at least one of their interlocking areas E, and, in practice, in line with each of them, for example by bonding or welding.

Preferably, also, in order to stiffen the accommodation volume V, the front faces 31A, 31B of this accommodation volume V are each locally fitted with ribs 32 which extend in annular fashion around the central hole 18, concentric with one another and coaxial with the hole.

Finally, preferably, the two shells 14A, 14B are of a single piece with one another, forming one and the same piece with their hinge area Z, and thus with the docking element 16.

Figure 8:
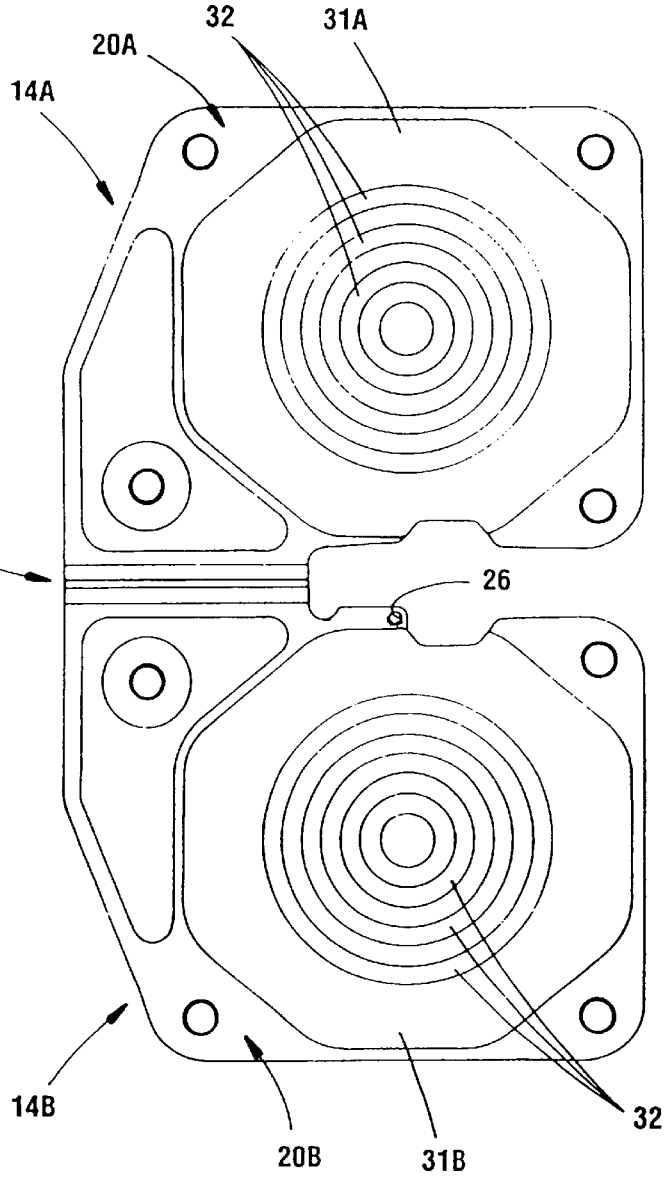
FIG. 8 is a plan view of the dispenser box according to the invention, represented opened out flat, seen from the inside.

For example, the dispenser box 14 thus constituted is produced, on the flat, by thermoforming, as represented in FIG. 8.

On assembly, a strip 13 of cabling accessories 10 is arranged in a roll in the part of the accommodation volume V delimited by one of the shells 14A, 14B, in practice by being wound in a spiral around the central hole of the shell, and the other of the shells 14A, 14B is then folded over onto the previous one, by pivoting about the hinge area Z, until the assembly is closed.

On completion of this closure, the two shells 14A, 14B are in engagement with one another via their interlocking areas E, the corresponding fastening possibly being reinforced by a securing feature, as set out above.

The externally endmost cabling accessory 10, on the strip 13, is engaged, via its metal barrel 11, in the piercing 26 provided for this purpose at the edge of the aperture 17, as represented in FIG. 1.

If desired, in order to strengthen the retention of the strip 13 of cabling accessories 10 with respect to the dispenser box 14, a strip of adhesive tape, not represented, is fastened straddling this dispenser box 14, in line with its aperture 17, passing around the outer part of this strip 13.

The dispenser box 14 according to the invention is then ready for use.

Figure 9:
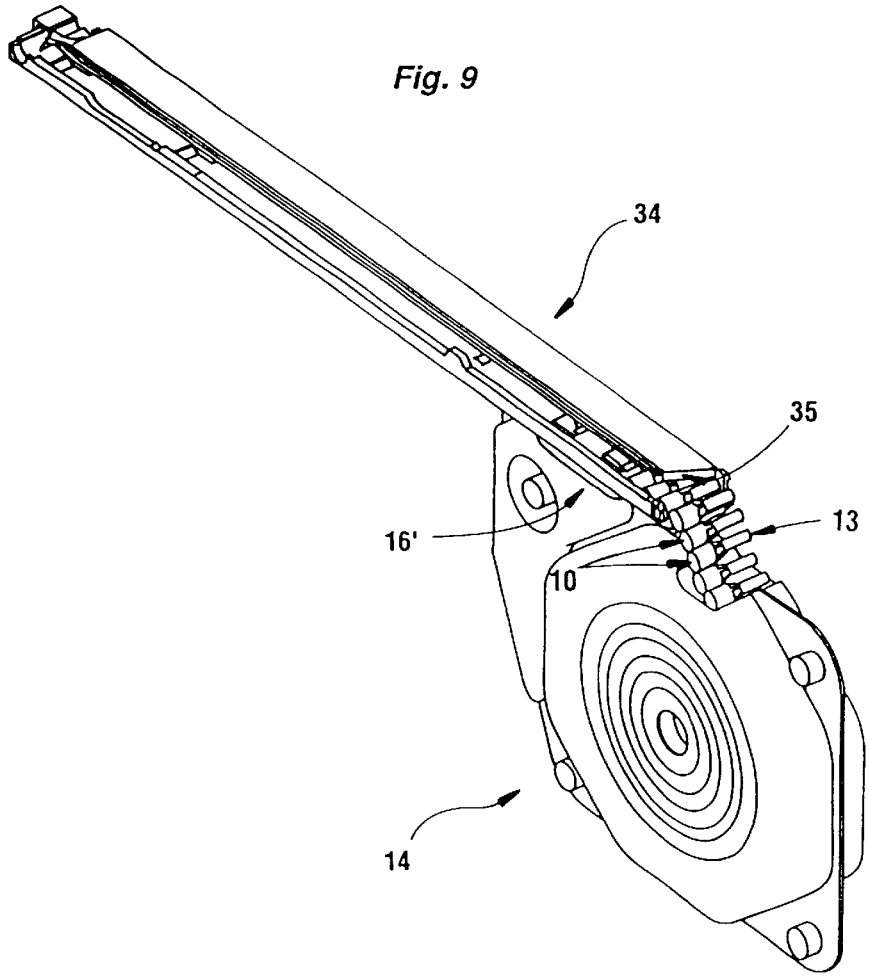
FIG. 9 is a view in perspective which, derived from that of FIG. 1, illustrates the use of this dispenser box on a straight-line loader, the whole being seen from above.
Figure 10:
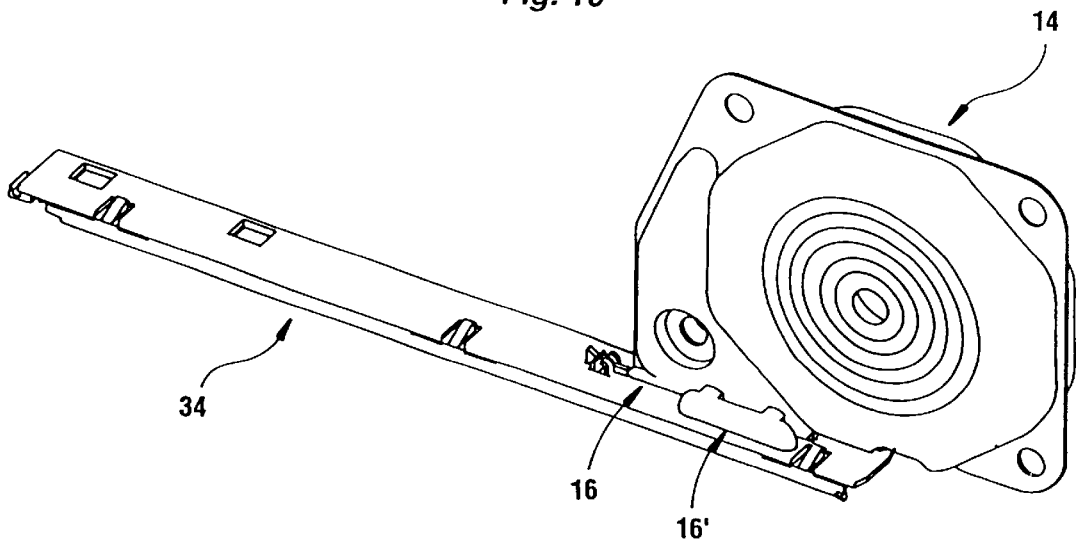
FIG. 10 is another view of this assembly in perspective, seen from below.

For example, and as represented in FIGS. 9 and 10, it is affixed, in order to do so, via its docking element 16, onto a loader 34, which is normally suitable only for receiving a linear arrangement of cabling accessories 10.

This loader 34, which is thus in a straight line overall, may, for example, be of the type described in the French patent which, filed on Feb. 5, 1998, under No. 88 01356, as a corollary to the French patent number 88 01355 already mentioned above, was published under No. 2 626 804.

In order thus to be equipped with a dispenser box 14, this loader 34 then, externally, includes a docking element 16' complementary to the docking element 16 of this dispenser box 14.

In the embodiment represented, this docking element 16', in practice, forms a hollow groove which, transversely, has an overall T-shaped profile similar to that of the projecting groove formed by the docking element 16 of the dispenser box 14.

In any event, the docking element 16' comes into proximity with one of the ends of the loader 34, in this instance the end 35 thereof opposite that at which the crimping of the cabling accessories 10 takes place, and this end 35 of the loader 34 is cleared, in order to facilitate insertion of the strip 13 of cabling accessories 10 extracted from the dispenser box 14.

Obviously, the present invention is not limited to the embodiment described and represented, but encompasses any variant implementation.

In particular, instead of being a projecting rib, the docking element of the dispenser box according to the invention may equally well be a recessed groove, the complementary docking element on the equipment onto which this dispenser box is to be affixed then forming a projecting groove instead of forming a recessed groove.

Moreover, this equipment is not necessarily a straight-line loader.

In fact, it could, for example, equally well take the form of the crimping tool used.

What is claimed is:

1. Dispenser box for cabling accessories, particularly for cable terminals, comprising two shells in face-to-face relationship along a common joint surface, said shells being fastened to each other, and together delimiting an accommodation volume for housing cabling accessories to be dispensed, an external docking element for affixing the dispensing box to another piece of equipment, and an aperture at a distance from said docking element suitable for passage of cabling accessories to the other piece of equipment, said shells being articulated to each other by a hinge area forming said docking element.

2. Dispenser box according to claim 1, wherein each of said shells has a flange extending over at least part of the periphery of the accommodation volume, respective flanges of said shells being contiguous with each other and defining a flat common joint surface therebetween.

3. Dispenser box according to claim 1, wherein said docking element comprises a projecting rib and has a T-shaped profile including a shank and a head at an outer end of the shank.

4. Dispenser box according to claim 2, wherein said docking element comprises a projecting rib and has a T-shaped profile including a shank and a head at an outer end of the shank, wherein said shank consists of respective portions of said flanges of said shells.

5. Dispenser box according to claim 3, wherein said head has oblique longitudinal flanks converging away from said shank.

6. Dispenser box according to claim 5, wherein said head has an overall trapezoidal profile in cross section.

7. Dispenser box according to claim 6, wherein a longitudinal groove extends along a small base of the trapezoidal profile of the head of said docking element.

8. Dispenser box according to claim 2, wherein said docking element extends longitudinally along adjoining edges of the flanges of said shells and away from said aperture.

9. Dispenser box according to claim 1, wherein said docking element includes portions of said shells on respective sides of the common joint surface.

10. Dispenser box according to claim 1, wherein the accommodation volume is of overall cylindrical configuration.

11. Dispenser box according to claim 10, wherein the accommodation volume extends annularly a central hole.

12. Dispenser box according to claim 10, wherein said aperture is defined in a side face of the accommodation volume of overall cylindrical configuration.

13. Dispenser box according to claim 1, wherein said aperture is located proximate to an end of said docking element, respective halves of said docking element being part of the respective shells.

14. Dispenser box according to claim 2, wherein the flange of at least one of said shells has a piercing at a border of said aperture.

15. Dispenser box according to claim 1, further comprising interlocking areas spaced around the accommodation volume for fastening said shells together.

16. Dispenser box according to claim 2, further comprising interlocking areas spaced around the accommodation volume for fastening said shells together, each of said interlocking areas comprising two complementary bosses belonging to respective flanges of said shells and interlockable into each other.

17. Dispenser box according to claim 16, wherein one of said pair of bosses is an inner boss and includes along generatrices of a sidewall of said inner boss for facilitating interlocking with the other, outer boss.

18. Dispenser box according to claim 15, wherein said shells are permanently secured to each other at said at least one of said interlocking areas.

19. Dispenser box according to claim 1, wherein said two shells are in one piece construction with each other and said docking element.

20. Dispenser box according to claim 19, wherein said one piece construction is thermoformed.

21. A dispenser box according to claim 1 wherein said docking element is complementary to an external docking element on a loader, the loader having an upstream end in alignment with said aperture for feeding the linear arrangement of cabling accessories from said dispenser box into the loader.

22. A dispenser box for cable accessories particularly for cable terminals, comprising two shells in face-to-face relationship along a common joint surface, said shells being fastened to each other, said shells together delimiting an accommodation volume for housing cabling accessories to be dispensed, an external docking element for affixing the dispensing box to another piece of equipment, and an aperture at a distance from said docking element suitable for passage of cabling accessories to the other piece of equipment, said docking element extending along adjoining edges of said shells and in a direction away from said aperture.

23. Dispenser box according to claim 22, wherein each of said shells has a flange extending over at least part of the periphery of the accommodation volume, respective flanges of said shells being contiguous with each other and defining a flat common joint surface therebetween, said docking element extending along adjoining edges of the flanges of said shells.

24. A dispenser box and loader assembly comprising a dispenser box, particularly for cable terminals, comprising two shells in face-to-face relationship along a common joint surface, said shells being fastened to each other, said shells together delimiting an accommodation volume for housing cabling accessories to be dispensed, an external docking element for affixing the dispensing box to another piece of equipment, and an aperture at a distance from said docking element suitable for passage of cabling accessories to the other piece of equipment, said docking element extending along adjoining edges of said shells and in a direction away from said aperture, and a loader having a docking element complementary to the docking element of said dispenser box for mounting said loader on said dispenser box, said loader having an upstream end in alignment with and spaced from said aperture for feeding a linear arrangement of cabling accessories from said dispenser box into said loader.

25. An assembly according to claim 24, wherein the docking element on the loader is located downstream of said upstream end of said loader.

26. An assembly according to claim 24, wherein each of said shells has a flange extending over at least part of the periphery of the accommodation volume, respective flanges of said shells being contiguous with each other and defining a flat common joint surface therebetween, said docking element on the dispenser box extending along adjoining edges of the flanges of said shells.

* * * * *